US008049612B2

(12) United States Patent
Pepper

(10) Patent No.: US 8,049,612 B2
(45) Date of Patent: Nov. 1, 2011

(54) METHOD AND APPARATUS FOR MONITORING FIRE DETECTORS

(75) Inventor: Stewart Pepper, Hertford (GB)

(73) Assignee: No Climb Products Limited, Hertfordshire (GB)

( * ) Notice: Subject to any disclaimer, the term of this patent is extended or adjusted under 35 U.S.C. 154(b) by 1488 days.

(21) Appl. No.: 10/503,745

(22) PCT Filed: Feb. 6, 2003

(86) PCT No.: PCT/GB03/00502

§ 371 (c)(1), (2), (4) Date: May 12, 2008

(87) PCT Pub. No.: WO03/067542

PCT Pub. Date: Aug. 14, 2003

(65) Prior Publication Data

US 2008/0224847 A1 Sep. 18, 2008

(30) Foreign Application Priority Data

Feb. 6, 2002 (GB) ..... 0202791.0

(51) Int. Cl.
*G08B 29/00* (2006.01)

(52) U.S. Cl. ..... 340/514; 340/506; 340/511; 340/516; 340/539.1; 340/539.11

(58) Field of Classification Search ..... 340/514, 340/506, 511, 516, 539.1, 539.11
See application file for complete search history.

(56) References Cited

U.S. PATENT DOCUMENTS

| | | | | |
|---|---|---|---|---|
| 5,154,504 | A | 10/1992 | Helal et al. | 362/20 |
| 6,423,962 | B1 | 7/2002 | Pepper | 250/222.1 |
| 7,167,088 | B2 * | 1/2007 | Farley | 340/514 |
| 7,649,450 | B2 * | 1/2010 | Campion et al. | 340/514 |
| 7,710,256 | B2 * | 5/2010 | Tawil | 340/514 |
| 2002/0101345 | A1 | 8/2002 | Pattok et al. | 340/516 |

FOREIGN PATENT DOCUMENTS

| | | |
|---|---|---|
| EP | 0 872 817 | 10/1998 |

* cited by examiner

*Primary Examiner* — Daryl Pope
(74) *Attorney, Agent, or Firm* — Renner, Kenner, Greive, Bobak, Taylor & Weber

(57) ABSTRACT

A hazard detector monitoring system comprises one or more smoke detectors each provided with an electronic device containing information unique to the detector so as to identify the detector. A testing device is located at the end of a pole and held adjacent the detector to read and write to the electronic device through a wireless communication link. The testing device causes the detector to carry out a predetermined operation and the result of the operation is read by the testing device from the electronic device using the wireless communication link together with the identity of the detector.

21 Claims, 3 Drawing Sheets

METHOD AND APPARATUS FOR MONITORING FIRE DETECTORS

The present invention relates to hazard detection systems. More particularly, but not exclusively, this invention relates to fire detector testers and a method and apparatus for monitoring fire detectors.

It will be appreciated that the present invention refers to hazard detectors and this should be taken to encompass fire, smoke, intruder and any detection system which may require monitoring and maintenance in a household or building.

Fire alarm systems in commercial and public buildings use a plurality of fire detectors strategically located around the buildings, usually on ceilings, and connected into a central alarm monitoring unit. The detectors are designed to respond to one or more indications of a fire such as smoke, heat and carbon monoxide. In order to ensure integrity of the alarm system and maintain fire certification for the premises, the system including all the detectors must be tested on a regular basis and a record maintained of the status of all items.

One method of testing a detector is for the detector to perform an automatic self test. However, this cannot supply a stimulus to the detector of the type it is intended to detect, ie smoke, heat, etc and can only check the electrical conductivity of the detector. A proper test requires the application of the appropriate stimulus, which is usually achieved by a suitable device attached to a long pole to provide access from ground level.

When a plurality of fire detectors is installed, it is necessary to identify each detector in order to maintain a record of when it was tested and the test result, so that it can be verified that all detectors have been tested. The identification is usually carried out manually but can also be done by a barcode, which may exist on the detector. This allows the detector to be identified but the barcode does not hold any further information.

Another technology exists in the field of identification but has not been associated with hazard detectors. This technology is Radio Frequency Identification and involves the use of an electronic tag which is capable of holding identification details as well as other useful information. The information is accessed by an interrogation signal being sent from an interrogator (also known as a reader) to the tag and the tag replying to this signal by sending requested information back to the interrogator. The interrogator can also pass information to the tag.

From one aspect, the present invention provides a hazard detector which includes an electronic device that contains data unique to said device and storing means to store other useful data.

The unique data provided by the electronic device may include the detector identity number and the other useful data stored by the device may include the date last tested and result of test.

From a second aspect, the present invention provides a testing device which is located on one end of an adjustable member, so as to reach a hazard detector, said testing device comprising:

reading means to read the data from the electronic device;

a control unit to control an operation to be performed by said testing device.

The testing device may also contain a transmitter and receiver for wireless signal handling between the testing device and another external device with similar wireless signal handling capabilities.

Additionally, the reading means can write data to the electronic device.

From a third aspect, the present invention provides a data recording device which comprises control means to store data received from a testing device and also control the overall monitoring process.

The data recording device may also contain a transmitter and receiver for wireless signal handling from an external device such as the testing device.

It should be appreciated that the data recording device may be incorporated into the testing device therefore removing the need for a separate data recording device.

It should also be appreciated that a communication path between the data recording device and the testing device may be a wired link as oppose to or in addition to a wireless link.

From an overall aspect, the present invention provides a method for monitoring hazard detectors, said method comprising the steps of:

providing the detector with an electronic device containing information unique to the detector;

bringing a testing device within close proximity of an electronic device;

causing the detector to carry out a predetermined operation;

recording the result of the operation of said electronic device;

reading data stored on said electronic device;

In order that the present invention be more readily understood, embodiments thereof will now be described by way of example with reference to the accompanying drawings, in which.

Figure 1:
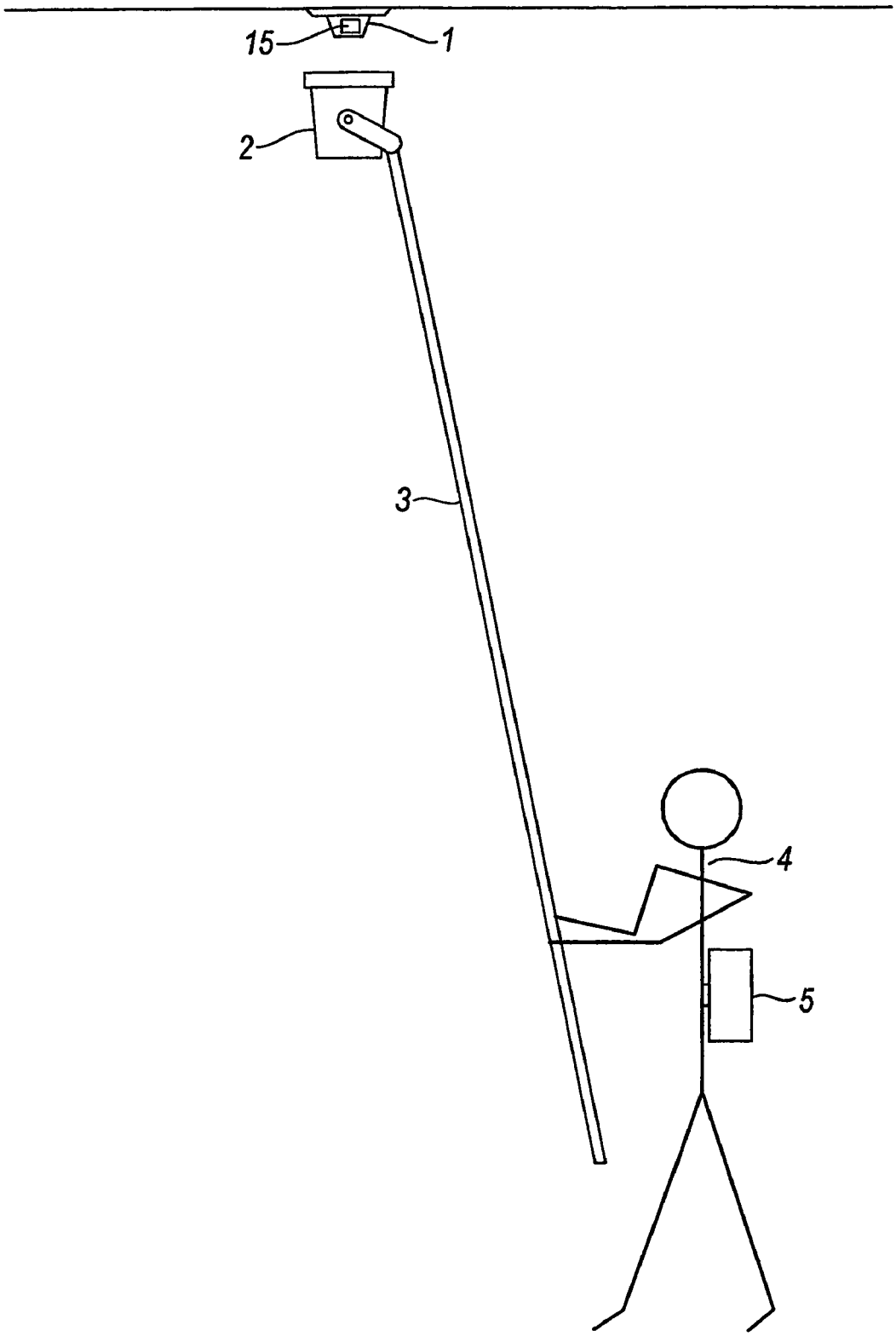
FIG. 1 shows the preferred arrangement provided by the present invention to monitor a hazard detector.

The monitoring apparatus of the present invention comprises two or more devices. A first device is an electronic device 15 which is included in a hazard detector 1. A second device is a testing device 2 which is located at the end of an adjustable member 3 such as a telescopic pole. The apparatus may also comprise a data recording device 5 which may be utilised to store monitoring data.

FIG. 1 shows a preferred arrangement of the monitoring apparatus. A hazard detector 1 is typically located on the ceiling of a room. The hazard detector 1 is provided with an electronic device 15 which is preferably a Radio Frequency Identification (RFID) tag which may communicate in a non-contact manner with a testing device 2. To easily access the hazard detector 1, an adjustable member 3 is provided with one end of the member 3 attached to the testing device 2. The adjustable member 3 is held by a user 4 and positioned so that the testing device 2 is in close proximity, typically a few centimeters, to the hazard detector 1. Preferably, the user 4 is provided with a data recording device 5 which is capable of controlling the testing device and storing the testing data. This is achieved through a communication path which is established between the testing device 2 and the data recording device 5. The path may be wired or wireless. It will be appreciated that the data recording device 5 may be incorporated into the testing device 2 removing the need for a separate data recording unit.

Additionally, data contained in such a testing device 2 may be examined in a remote location at a later time. For example, the user 4 may attach the testing device 2 to a computer in an office and download the data from the device 2 to the computer. The data may then be examined and any further instructions may be uploaded to the testing device from said computer and delivered to the electronic device when it is next monitored.

The hazard detector will now be described in more detail by referring to FIG. 2.

Figure 2:
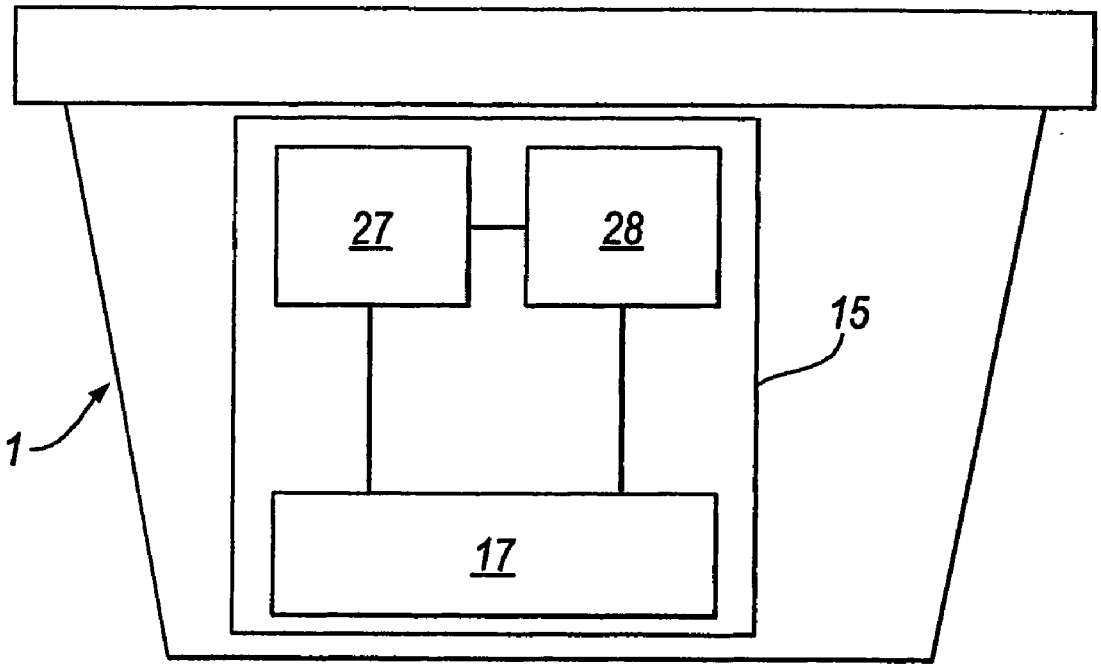
FIG. 2 shows a more detailed view of the hazard detector in FIG. 1.

FIG. 2 shows a hazard detector 1 containing an electronic device 15 which is preferably a Radio Frequency Identification (RFID) tag. This is in addition to any parts associated with its hazard detection function. The electronic device 15 comprises a storage means 27, a control means 28 and a field coupling means 17. The storage means typically includes both RAM (random access memory) and ROM (read-only memory). This allows data that is unique to the detector 1 to be stored in the ROM and hence remain unchangeable and allow changeable data such as test results to be stored in the RAM. The control means 28 controls the operation carried out by the electronic device 15. The field coupling means 17 couples the electronic device 15 to the testing device 2 by means of a radio frequency electromagnetic field in order to provide power to the electronic device 15 and also to convey data in either direction.

Figure 3:
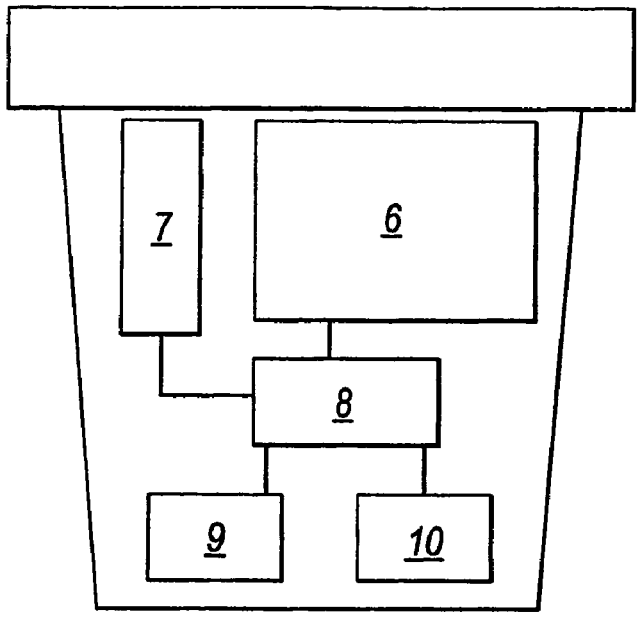
FIG. 3 shows a more detailed view of the testing device in FIG. 1.

The testing device 2 will now be described in more detail by referring to FIG. 3. the normal function of testing the detector 1 is carried out by the apparatus 6 which provides an appropriate stimulus to the detector, for example heat or simulated smoke. This does not form part of the present invention. The testing device 2 also comprises reading means 7, a control unit 8, and preferably a transmitter 9 and receiver 10.

The reading means 7 generates a radio frequency field which both powers the device 15 and reads data from it. This field can also cause data to be written to the device 15 and be stored in it. Data read from the device 15 by the reading means 7 is passed to the control unit 8. The control unit 8 is capable of communicating with a data recording device, preferably by using radio transmitter 9 and receiver 10. This communication could alternatively be provided by other means such as a cable, but this would be less convenient. The frequency to communicate between the two devices is predetermined and differs from the frequency utilised between the electronic device 15 and the testing device 2.

Figure 4:
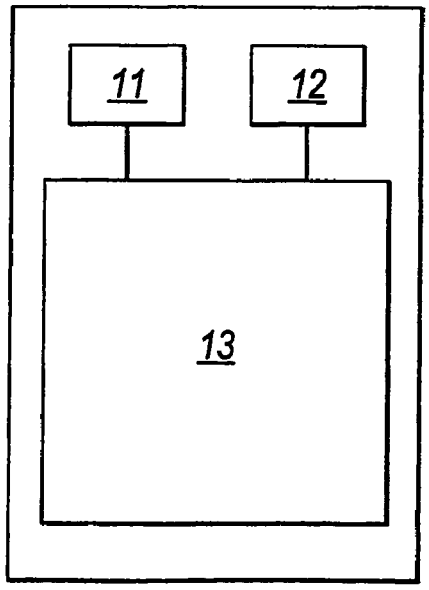
FIG. 4 shows a more detailed view of the data recording device in FIG. 1.

The data recording device 5 will now be described in more detail with reference to FIG. 4.

The data recording device 5 is typically located some distance away from the testing device 2 as required for obtaining convenient access. The data recording device 5 preferably comprises a receiver 11 and transmitter 12 to communicate with its respective transmitter 9 and receiver 10 on the testing device 2. The device further comprises control means 13 which can store data received from the testing device 2 through the wireless communication path, and also to control the overall testing process.

It will be appreciated that the receiver 11 and transmitter 12 may not be required if a wired connection is utilised between the testing device 2 and the recording device 5.

It will also be appreciated that the control means 13 may be included in the testing device 2 hence removing the need for a separate data recording unit.

The invention claimed is:

1. A method for monitoring a hazard detector, said method comprising the steps of:

providing the detector with an electronic device containing data unique to the detector;

recording additional data relating to the detector in the electronic device;

bringing a testing device and the electronic device within close proximity of each other;

reading the data unique to the detector and the additional data stored in the electronic device using the testing device.

2. The method according to claim 1, further comprising the step of causing the detector to carry out a predetermined operation and wherein the additional data includes the result of the operation.

3. The method according to claim 1, wherein the reading step comprises:

generating an electromagnetic field by the testing device in order to power the electronic device and to read a wireless signal representative of the data stored in the electronic device.

4. The method according to claim 1, wherein the method further comprises the step of writing further data to the electronic device.

5. The method according to claim 1, wherein the result of monitoring the hazard detector is stored in the electronic device.

6. The method according to claim 1, wherein the result of monitoring the hazard detector is stored in the testing device.

7. The method according to claim 1, wherein the electronic device is a radio frequency identification (RFID) tag.

8. A hazard detector comprising hazard detection means associated with an electronic device, wherein the electronic device comprises: a first storage means for storing data unique to the detector; a second storage means for storing additional data relating to the detector; and a coupling means for sending a wireless signal representative of the data stored in the first and second storage means to a testing device, in response to an interrogation signal from the testing device.

9. The hazard detector according to claim 8 wherein the interrogation signal from the testing device causes the electronic device to be powered.

10. The hazard detector according to claim 8 wherein the coupling means is arranged to receive a signal representative of additional data from the testing device.

11. The hazard detector according to claim 8 wherein the additional data includes test results and the hazard detection means is arranged to provide the test results to the electronic device.

12. The hazard detector according to claim 8 wherein the wireless data signal is a radio frequency signal.

13. The hazard detector according to claim 8 wherein the first storage means is a read only memory (ROM) device and the second storage means is rewritable memory device.

14. The hazard detector according to claim 8 wherein the hazard detector is a smoke detector.

15. The hazard detector according to claim 8 wherein the electronic device is a radio frequency identification (RFID) tag.

16. A testing device for use with a hazard detector, the device being located on one end of an elongate member, said testing device comprising:

means for reading a wireless signal representative of data stored in an electronic device provided on the hazard detector;

a control unit to control operations performed by the testing device.

17. The testing device according to claim 16 wherein the reading means is arranged to transmit an interrogation signal to the electronic device in order to power the electronic device.

18. The testing device according to claim 16 wherein the reading means is arranged to write additional data to the electronic device.

19. The testing device according to claim 16, further comprising:

a transmitter and receiver.

20. The testing device according to claim 16, further comprising means for providing a test stimulus to the detector.

21. A monitoring arrangement for a hazard detector comprising a testing device for use with the hazard detector, the device being located on one end of an elongate member, said testing device including means for reading a wireless signal representative of data stored in an electronic device provided on the hazard detector, a control unit to control operations performed by the testing device; the hazard detector including hazard detection means associated with an electronic device, wherein the electronic device includes a first storage means for storing data unique to the detector, a second storage means for storing additional data relating to the detector, and a coupling means for sending a wireless signal representative of the data stored in the first and second storage means to the testing device, in response to an interrogation signal from the testing device.

* * * * *